US005354410A

United States Patent [19]

Cohen et al.

[11] Patent Number: 5,354,410

[45] Date of Patent: Oct. 11, 1994

[54] APPARATUS FOR APPLYING TAPE TO A FRAME FOR GLAZING

[75] Inventors: Lewis S. Cohen, Hingham, Mass.; Reid Davies, Huntington, Calif.; Michael J. Powell, Kingston; Steve Forti, Norwell, both of Mass.

[73] Assignee: Venture Tape Corporation, Rockland, Mass.

[21] Appl. No.: 23,324

[22] Filed: Feb. 26, 1993

[51] Int. Cl.[5] ..... B22B 31/10

[52] U.S. Cl. ..... 156/552; 156/459; 156/468; 156/486

[58] Field of Search ..... 156/391, 486, 545, 530, 156/577, 522, 552, 475, 459, 558, 468

[56] References Cited

U.S. PATENT DOCUMENTS 3,892,618 7/1975 Griebat ..... 156/545 X
4,060,444 11/1977 Schweig, Jr. et al. ..... 156/391
4,623,421 11/1986 Cardin ..... 156/577 X

*Primary Examiner*—Michael W. Ball
*Assistant Examiner*—Michele K. Yoder
*Attorney, Agent, or Firm*—Wolf, Greenfield & Sacks

[57] ABSTRACT

A tape applicator for application of a double-sided adhesive tape to a member which can be cut and assembled to form a frame for glazing for a skylight, a window or a door. The tape applicator includes a spindle for accepting a plurality of rolls of tape and apparatus for guiding the frame member past the roll of tape to permit accurate and dependable application of the tape to the frame member. A spring mounted block urges the tape into tight, adhesively bonded relation with the frame member at the desired location. The guiding apparatus is removable to allow selection and installation of an appropriate guiding apparatus configured to accept the cross-sectional size and shape of the particular frame member to which it is desired to apply tape. A wall acts as a stop to align the tape with the frame member. When the tape from a particular roll has been exhausted, the remaining core can be pushed past the wall into a recess to allow advancement of the next available roll into position.

10 Claims, 5 Drawing Sheets

APPARATUS FOR APPLYING TAPE TO A FRAME FOR GLAZING

FIELD OF THE INVENTION

This invention relates generally to adhesive tape applicators, and more particularly to apparatus for applying tape to the components of a frame for glazing.

BACKGROUND OF THE INVENTION

In conventional windows, doors, skylights and the like, adhesive tape is commonly used to seal and secure the glazing to the frame into which it is installed. The tape used typically has a high tack adhesive disposed on both sides of a carrier and a release liner covering the adhesive on one side of the tape. The release liner remains in place until installation of the glazing, at which time it is removed. One side of the tape, the side without the release liner, is secured to a shelf on the frame member, and the other side of the tape is secured to the glazing adjacent the outer edges thereof. The shelf supports the glazing in the assembled frame. The use of such adhesive tapes permit rapid assembly of doors, windows and skylights, and provides a low cost, secure seal. Such adhesive tapes are particularly commonly used with frames formed of extruded plastic members, although these tapes can also be used with aluminum frames, wooden frames and the like. A typical tape used for such applications can be obtained from Venture Tape Corp. under the product designations VG132, VG116, VG108 and VG316 (Venture glazing tape). Such tapes are provided on a roll having a central cardboard core about which the tape is wound. Such tapes are available in any width desired, such as in a range of from ¼" to 3".

At present, such tapes are commonly applied by hand to the shelf of a frame member, and the frame member is subsequently cut, mitered and assembled to form the desired frame. Such manual application of the tape to the frame member is time consuming and thus, results in a large labor cost in the preparation of the frame member. In addition, such manual application is subject to error, and often the tape is not properly aligned or positioned on the frame member.

It is therefore an object of the present invention to provide apparatus for applying tape to a member which can be formed into a frame for glazing.

It is a further object of the present invention to provide a method of application of tape to a member which can be formed into a frame for glazing, which method accurately applies the tape and minimizes the amount of manual labor required.

It is another further object of the present invention to provide apparatus for applying tape to a member which can be formed into a frame for glazing, which apparatus can accommodate any size and shape frame member.

It is yet another further object of the present invention to provide apparatus for applying tape to a member which can be formed into a frame for glazing, which apparatus permits sequential use of multiple rolls of tape.

SUMMARY OF THE INVENTION

The above and other objects are achieved in accordance with the present invention in which apparatus is provided which accurately and quickly applies tape to any frame member, regardless of size or shape, and in which multiple rolls of tape can be mounted and utilized before any restocking is required.

In one aspect of the invention, the apparatus is provided with an easily replaced guide which directs the frame member through the tape applicator to insure that the tape is precisely applied to the correct portion of the frame member along the length of the frame member. A different guide is installed for each frame member with a different cross-sectional shape or size. The guide includes guide blocks which direct the frame member through the tape applicator and a roller over which the tape passes. A spring biased block urges the tape downwardly against the shelf of the frame member onto which the tape is to be applied to insure proper adhesion of the tape to the shelf.

In another aspect of this invention, the rolls of tape are mounted on a fixed spindle or tube which can accommodate a plurality of rolls at any one time. This tube is mounted onto a recessed bracket, a specified distance above a top edge of a wall which serves to align the rolls of tape with respect to the guide and which serves as a stop. As the tape is used up, and the size of the roll becomes less than the distance between the tube and the top edge of the wall, the core of the roll can be pushed past the wall into the recess in the bracket to allow the next adjacent roll to be moved into position adjacent the wall. The used roll core remains in the recess disposed on the opposite side of the wall until the recess is filled with such used cores. Thereafter all the cores are removed, and a new set of tape rolls is mounted onto the tube.

In a further aspect of this invention, a method is provided for automatic application of tape to the shelf of a frame member in which the member is urged through a guide configured to accept that particular frame member and past a roll of tape mounted on a spindle. The tape is urged into binding contact with the shelf of the frame member. The guide is interchangeable with other guides to permit use of the apparatus with frame members of different sizes and shapes. A plurality of rolls of tape may be used, and a new roll is moved into position by pushing the core of the old roll along the spindle past a stop and urging the new roll against the stop to place it into the desired position for application of the tape to the shelf.

Through the use of multiple guides which can be mounted interchangeably on the apparatus, the same tape application apparatus can be used for any size and shape frame member. In addition, the tape is applied to the proper location on the shelf of a frame member all along the length regardless of the size or configuration of that frame member. Finally, multiple rolls of tape can be used at one time. As one roll is finished, another is readily moved into the precisely correct position for application to the frame member, with minimal effort by the operator.

BRIEF DESCRIPTION OF THE DRAWINGS

The objects, advantages and features of this invention will be more clearly appreciated from the following detailed description when taken in conjunction with the accompanying drawings in which.

DETAILED DESCRIPTION OF THE PREFERRED EMBODIMENTS

Figure 1:
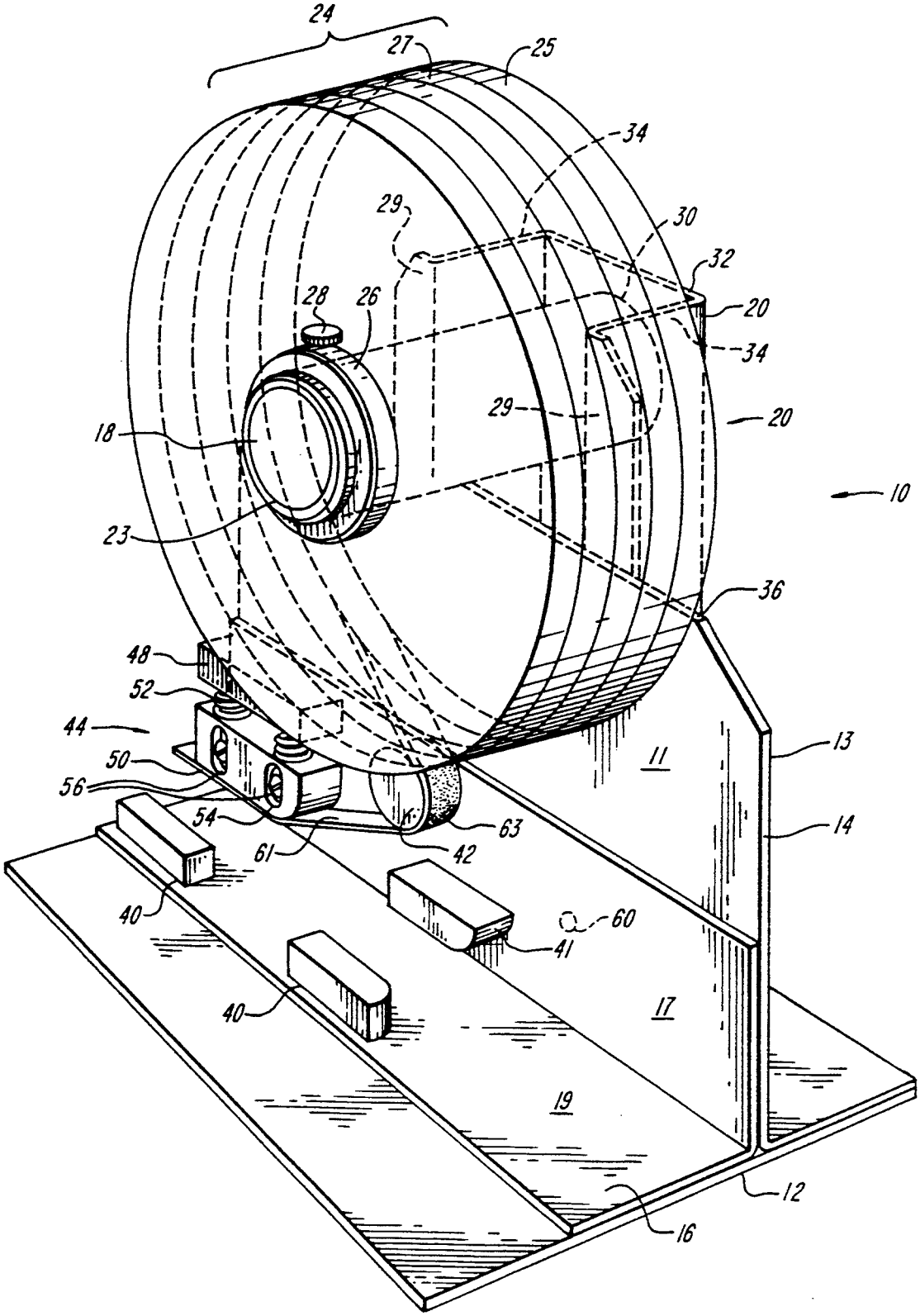
FIG. 1 is a front perspective view of the tape applicator of this invention.
Figure 5:
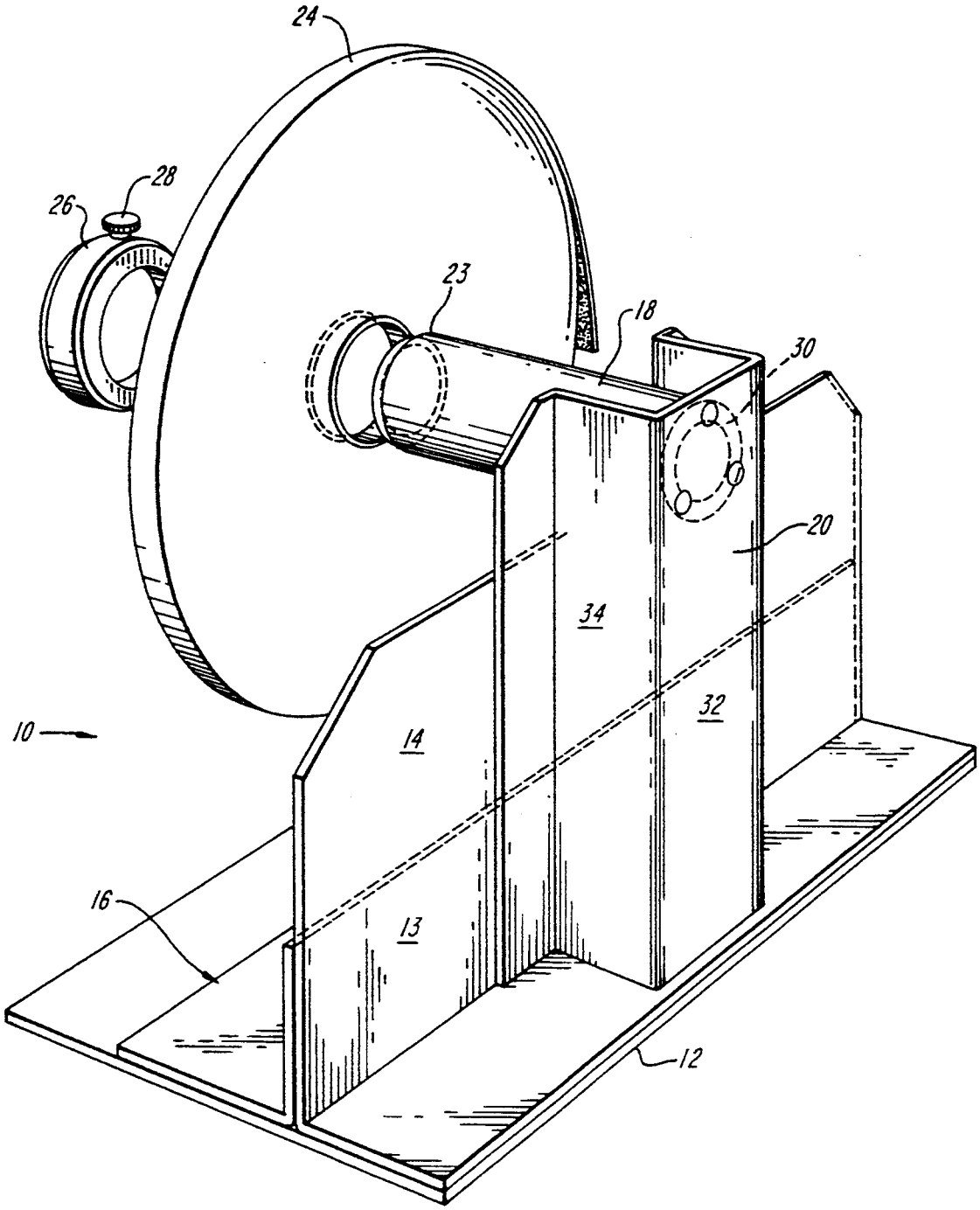
FIG. 5 is a rear perspective view of the tape applicator of FIG. 1.

With reference now to the drawings, and more particularly to FIGS. 1 and 5 thereof, a preferred embodiment of the tape applicator 10 of this invention will be described. Applicator 10 includes a base 12, an upstanding wall 14, guide 16, spindle 18 and spindle support 20.

Wall 14 is secured to base 12, and is oriented generally orthogonal of spindle 18. Wall 14 serves to align rolls 24 of tape with guide 16 and acts as a stop to limit movement of rolls 24 of tape along spindle 18. Spindle 18 has substantially the same outside diameter as the inside diameter of the cores 22 (FIG. 2) of the rolls 24 of tape which are to be used with applicator 10. Preferably, spindle 18 is provided with a generally horizontal orientation, so that when cores 22 are mounted thereon, the tape on rolls 24 can be removed downwardly toward guide 16, as will be described. However, other orientations of spindle 18 are also possible. The tape is wound on the rolls 24 so that an adhesive side covered by a release liner 61 faces outwardly and the side with an exposed adhesive layer 63 faces downwardly. As the tape is removed from rolls 24, rolls 24 are permitted to rotate about spindle 18 to allow the provision of a continuous supply of tape from the rolls, as needed. A collar 26 is disposed about spindle 18 between chamfered free end 23 of spindle 18 and rolls 24 and serves to retain rolls 24 in place on cylinder 18 against face 11 of wall 14. Collar 26 includes a set screw 28 which can be tightened against the outer surface of spindle 18 to restrict movement of collar 26, and thus of rolls 24. Loosening of set screw 28 allows movement of collar 26 with respect to spindle 18 in a known manner.

Spindle 18 is supported by support 20. Support 20 typically is mounted onto a face 13 of wall 14 opposite of face 11. If desired, support 20 also can be supported by base 12. An end 30 of spindle 18 is mounted onto a wall 32 of support 20. Wall 32 is spaced from face 13 of wall 14 a specified distance. End 30 is also positioned within support 20 such that end 30 is spaced from side walls 34 of support 20 a distance which is greater than the thickness of cores 22 measured in a direction extending radially from the center of spindle 18. Moreover, the outer surface of spindle 18 is spaced above top edge 36 of wall 14 a distance which is greater than the thickness of cores 22 measured in a direction extending radially from the center of spindle 18. The foregoing spacing allows one to push a core 22 of roll 25 from which all the tape has been removed axially along spindle 18 past wall 14 and into the recess in support 20 formed by walls 32 and 34. Such movement permits the next adjacent roll 27 of tape to be moved into position against wall 14 and utilized, thus facilitating the speedy replacement of one roll by another without the need to remove used cores from spindle 18.

Since roll 25 of tape rubs against face 11 of wall 14 as tape is being unwound therefrom, preferably face 11 above guide 16 is coated with a layer of a low friction material to reduce the functional drag on the roll 25 and to prevent damage to the tape of roll 25. A preferred material is a high molecular weight polyethylene. The confronting surfaces 29 of support 20 may also be coated with such a low friction material for the same reason.

Guide 16 includes walls 17 and 19, a plurality of guide blocks 40 and 41, tape roller 42 and a spring mounted bearing block assembly 44. Wall 17 typically is parallel to wall 14, and wall 19 is generally parallel to base 12. Typically, two guideblocks 40 are mounted onto wall 19, while a single guideblock 41 is mounted onto wall 17. Guide blocks 40 serve to guide an associated frame member 46 through tape applicator 10, so that it is positioned in precisely the right location for application of-tape thereto. Roller 42 guides the tape of roll 25, while bearing block assembly 44 urges layer 63 of the tape into a tight, bonding relationship with the appropriate location on frame member 46. Bearing block assembly 44 typically, although not necessarily, may include a fixed mount 48 and moveable block 50. Mount 48 is fixably secured to wall 17 of guide 16. Extension springs 52 connect block 50 to mount 48. Block 50 is provided with slots 56 which are elongated in a direction generally parallel to wall 17 of guide 16. Guide screws 54 extend through slots 56 and are mounted onto wall 17 of guide 16. Guide screws 54 permit movement of block 50 with respect to block 50 under the influence of springs 52 in a direction perpendicular to wall 19 of guide 16, but prevent lateral movement of block 50 either parallel to wall 19 of guide 16, or perpendicular to wall 17 of guide 16. Springs 52 insure that a bearing force is applied by bearing block 50 onto the tape to urge layer 63 into binding contact with a frame member 46, as described.

Guide 16 is customized for the cross-sectional size and shape of each particular frame member 46 to which it is desired to apply tape. Blocks 40 and 41, bearing block assembly 44 and roller 42 are each positioned on guide 16 to conform to the particular cross-sectional size and shape of the frame member 46. Guide 16 is readily interchangeable with a different guide 16 configured for a different size or shape frame member. Typically, guide 16 is held in place by studs 60 which extend from the backside of wall 17 through wall 14. Preferably, nuts or other like fasteners 51 are used with studs 60 to secure wall 17 to wall 14. However, these fasteners should be easily removable to allow rapid replacement of guide 16. Typically, two such studs 60 are provided to prevent movement of guide 16, and to assure proper alignment thereof with respect to wall 14.

Figure 2:
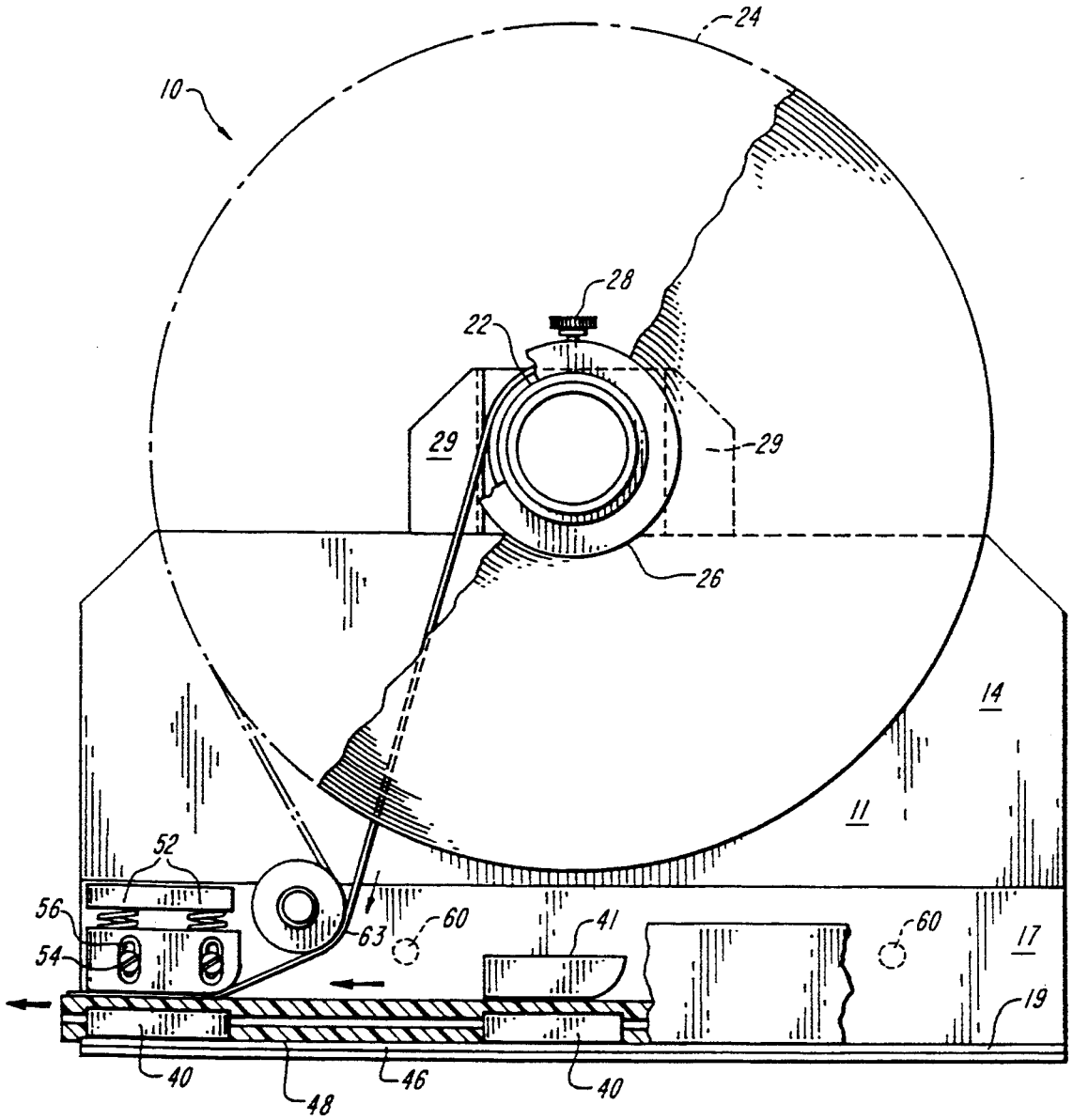
FIG. 2 is a partially cutaway front plan view of the application of FIG. 1 showing the application of tape to a frame member.
Figure 3:
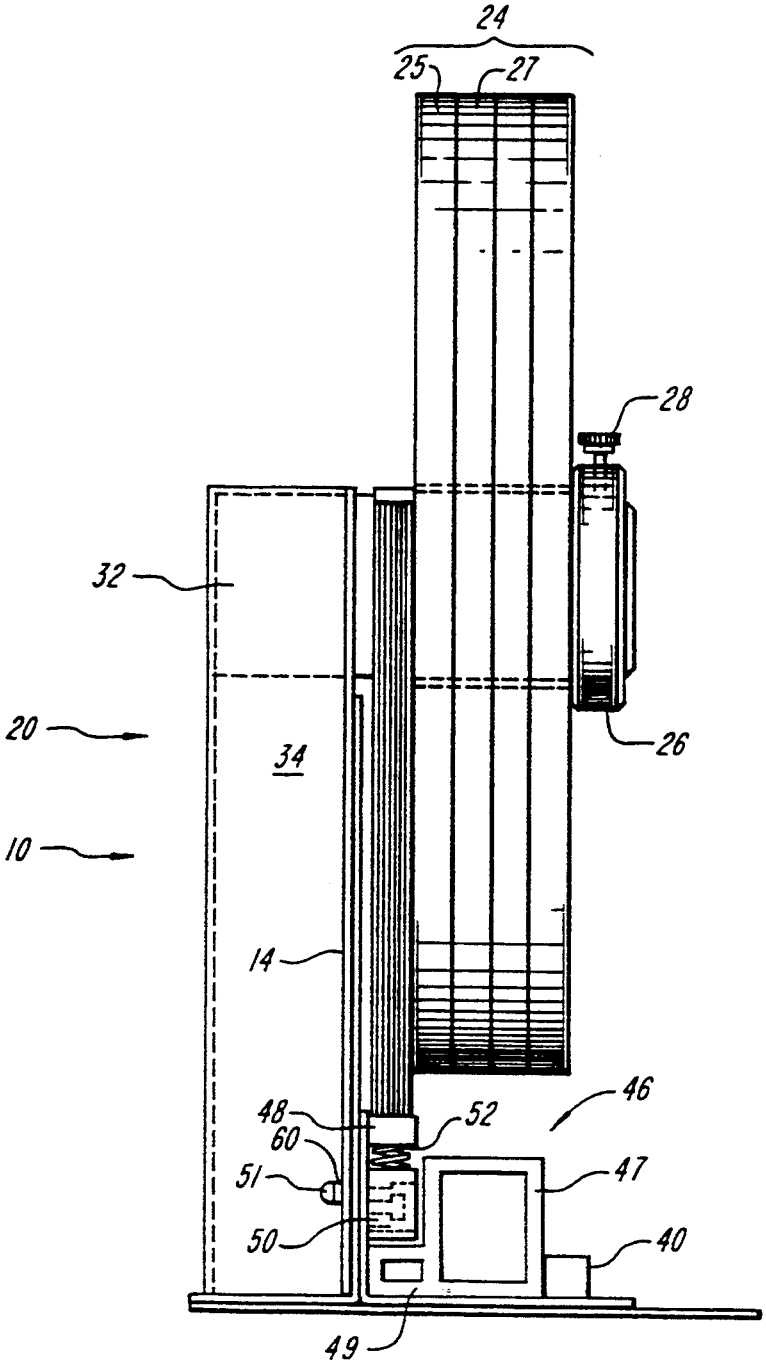
FIG. 3 is left side plan view of the applicator of FIG. 2.
Figure 4:
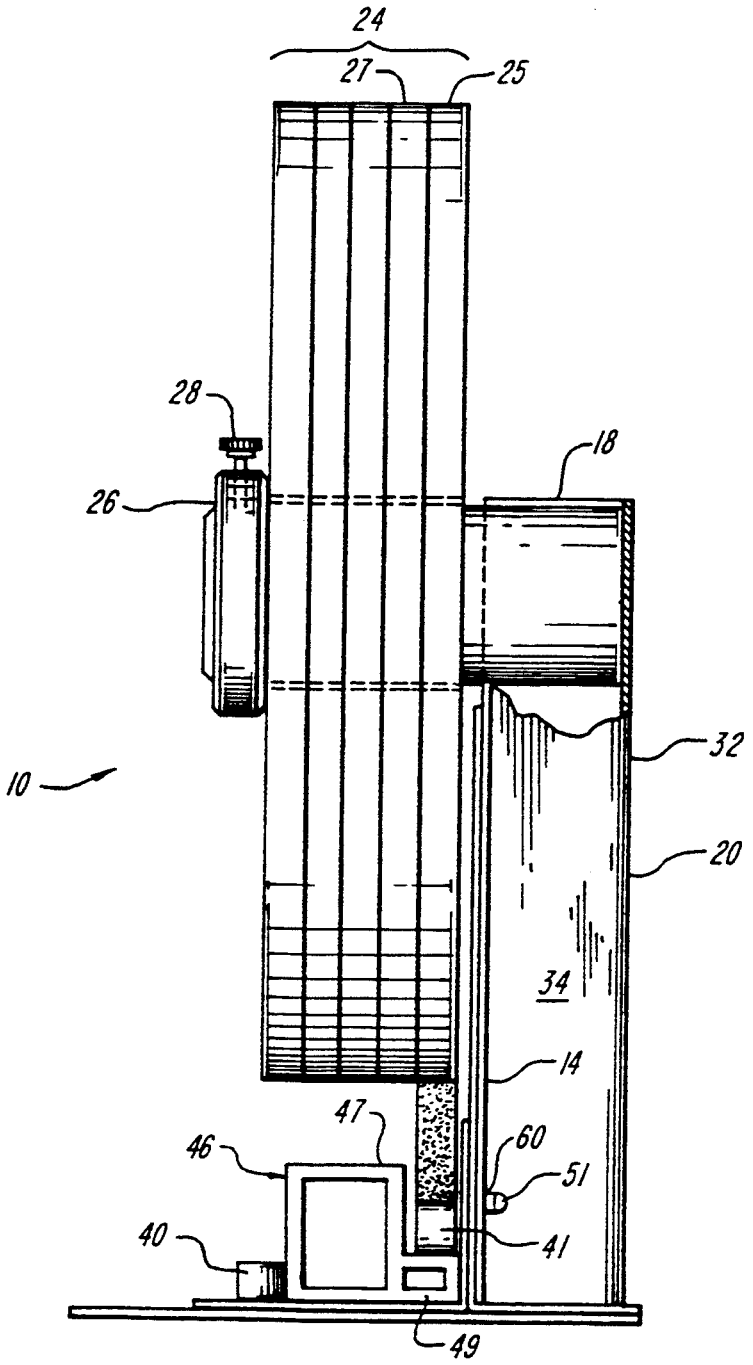
FIG. 4 is a right side plan view of the tape applicator of FIG. 2.

Use and operation of applicator 10 will now be described with particular reference to FIGS. 2–4. Initially, prior to use of applicator 10, several rolls 24 of tape are mounted onto spindle 18. A typical number of rolls for which spindle 18 may be designed is five rolls, although spindle 18 may be designed for a greater or lesser number of rolls, depending upon the needs of the user. The rolls of tape are installed by sliding their cores 22 over chamfered end 23 of spindle 18. Collar 26 is then slid onto spindle 18 over end 23 and adjusted axially along spindle 18 until it is snug against the outer surface of the roll 24 most closely adjacent end 23. Set screw 28 is then tightened to prevent any axial movement of rolls 24 or collar 26. At this point, innermost roll 25 is closely adjacent wall 14, which acts as a stop, and roll 25 is typically in contact with wall 14. Tape is always removed first from roll 25.

A particular guide 16 is selected which is designed to be used in conjunction with the frame member 46 to which tape is to be applied. The selected guide 16 is installed simply by placing the guide on base 12 and sliding studs 60 through mating holes in wall 14. Studs 60 are then typically secured to wall 14 by the use of a nut or other like fastener. Tape is removed initially from roll 25 manually by guiding the tape around roller 42 and beneath block 50 so that liner 61 faces upwardly and layer 63 faces downwardly. Once the tape is in this position, frame member 46 is advanced through guide 16.

A typical frame member can be formed of a compound of a plastic extrusion, aluminum, wood or other like material. As shown in FIG. 3 frame member 46, in cross-section, typically includes structural segment 47 and a shelf 49. Segment 47 provides structural strength to the frame member, while shelf 49 is the portion upon which the glazing rests during installation. Therefore, the tape is to be applied to the surface of shelf 49 with the liner 61 on the tape facing upwardly and layer 63 being secured to shelf 49.

Frame member 46 may be advanced through applicator 10 either manually, or using an automatic feed. In either event, the distal end of an elongated member of a typical predetermined length is advanced through guide 16 in an orientation such that shelf 49 is disposed below block 50 and element 47 is disposed to one side of block 50 on a side thereof opposite wall 17. Blocks 40 guide an outside lateral surface of element 47, while block 41 rides above shelf 49 and insures that frame member 46 is disposed parallel with wall 19 of guide bracket 16, and does not tilt or pivot with respect thereto. As a result, as shelf 49 passes beneath block 50, it is parallel to the lower surface of block 50, and thus the tape disposed therebetween. As shelf 49 is advanced past block 50, block 50 urges layer 63 of the tape into contact with the shelf 49. Because of the high tack nature of the adhesive used, the tape immediately adheres to shelf 49. Further advance of the frame member 46 through 16 automatically pulls tape from roll 25 and applies it to the remainder of shelf 49. Because frame member 46 is properly aligned with respect to guide 16 by blocks 40 and 41, tape is applied only to shelf 49 and not to some other portion of frame member 46, and it is applied at precisely the correct location all along the length of shelf 49. When the proximal end of frame member 46 is finally advanced past guide 16, the tape is cut evenly with the proximal end of member 46. This cutting procedure can be either manual, such as by the use of a knife, or it can be automated such that when the proximal end of the member is reached, a blade (not shown) automatically cuts the tape at that point.

When all of the tape has been removed from roll 25, the operator releases set screw 28 and advances collar 26 toward wall 14. This action pushes the next adjacent roll 27 into contacting relationship with wall 14 and urges the core 22 of roll 25 past edge 36 of wall 14 and into the recess defined by walls 32 and 34. Therefore, when the tape from roll 25 is exhausted, the operator need not go through the time consuming and elaborate process of installing a new roll and removing the old core from spindle 18. Furthermore, wall 14 acts as a stop to allow the operator to immediately advance roll 27 to precisely the correct position without the need of any careful alignment, thus reducing the amount of time required for placing a new roll in position for use. Similarly, when roll 27 is exhausted, the next roll in line is advanced into position, and the core 22 from this roll can be pushed into the recess defined by walls 32 and 34. When the recess defined by walls 32 and 34 is completely filled, such as by the insertion of the cores from 5 or more rolls, the operation must be stopped, and the cores must be extracted past end 23 of spindle 18. Thereafter, more rolls 24 are mounted onto spindle 18, as previously described, and the operation is repeated.

If at any time, a frame member 46 having a different cross-sectional configuration or size is selected, it can be accommodated by quickly replacing the existing guide 16 with a new guide 16 configured to accept that frame member 46, as described.

Typically applicator 10 is used indoors in a shop in which the windows, skylights or doors are assembled. Typically, once the tape is applied to a frame member, the frame member is cut, mitered and assembled in the usual fashion to form the door, window or skylight. Thereafter, release liner 61 is removed from the tape and the glazing is dropped into the frame and secured against the adhesive on shelf 49. However, applicator 10 may also be used at the job site.

Block 50 and roller 42 are configured to be sufficiently wide that they can accommodate a tape of the width to be used, which is typically a function of the width of shelf 49. Preferably, block 50 is as wide or wider than the widest tape selected for use with that particular guide 16. Similarly, roller 42 is also as wide as or wider than the widest tape designed to be used with that particular guide 16.

Base 12, guide bracket 16, wall 14, spindle 18 and support 20 typically are formed of a rigid, durable material, such as steel, a rigid plastic, or the like. However, other rigid materials are suitable so long as they have the desired structural strength and rigidity. Blocks 40, 41 and 50 are all typically formed of the same material, although they need not be. These blocks preferably are formed of a material which has low friction, but high strength. One preferred material used for these blocks is a an ultra high molecular weight polyethelene, although other materials could be used.

While in the preferred embodiment, collar 26 is moved manually, and can only be moved after set screw 28 has been loosened, collar 26 also could be spring biased toward wall 14 in a known manner. Thus, when all of the tape has been exhausted from roll 25, the spring would automatically urge the core of roll 25 past edge 36 and automatically advance roll 27 into position for use. In this embodiment, a set screw 28 could either be used or not, depending upon the requirements of the user.

Applicator 10 of this invention reduces the labor time required to apply tape to a frame member prior to assembly of a door, window or skylight, and significantly improves the accuracy with which the tape is applied to the shelf of the frame member. In addition, the same applicator can be used to apply tape to any size frame member typically used for such applications. Finally, this invention permits the use of several rolls of tape before the application process must be stopped for replenishment of the supply of tape on the applicator. This feature increases productivity and significantly reduces down time.

In view of the above description, it is likely that modifications and improvements will occur to those skilled in the art which are within the scope of this invention. The above description is intended to be exemplary only, the scope of the invention being defined by the following claims and their equivalents.

What is claimed is:

1. Apparatus for applying tape having an adhesive layer to a member forming a component of a frame for glazing, the member having a shelf on which glazing rests when the frame is assembled, said apparatus comprising:

a spindle onto which a roll of tape is mounted, said spindle passing through a central core of the roll of tape, the roll of tape being permitted to rotate about said spindle;

means for urging the layer of adhesive of the tape against the shelf of the member as the member is advanced through said apparatus, said member being positioned such that the tape is applied only to the shelf of the member;

a first guide for aligning the shelf with the urging means with respect to a direction transverse to a direction of movement of the member through said apparatus past the roll of tape;

a second guide for guiding the shelf beneath said urging means as the member moves through said apparatus; and a stationary lower wall spaced from said urging means and said second guide, the member being disposed between said second guide and said lower wall as the member moves through said apparatus.

2. Apparatus as recited in claim 1 further comprising means for aligning the roll of tape with respect to said urging means.

3. Apparatus as recited in claim 2 wherein said aligning means comprises a wall disposed generally orthogonally with respect to said spindle.

4. Apparatus as recited in claim 1 wherein said urging means, said first guide, said second guide and said lower wall are removable from said apparatus to allow replacement thereof.

5. An apparatus as recited in claim 1 wherein said spindle is adapted to receive a plurality of rolls of tape, only one roll of which is used at any one time.

6. Apparatus for applying tape having an adhesive layer to a member forming a component of a frame for glazing, said apparatus comprising:

a spindle onto which a roll of tape is mounted, said spindle passing through a central core of the roll of tape, the roll of tape being permitted to rotate about said spindle, said spindle being adapted to receive a plurality of rolls of tape, only one roll of which is used at any one time;

means for guiding the frame member through said apparatus past the roll of tape;

means for urging the layer of adhesive of the tape against a portion of the frame member as the frame member is advanced through said guiding means, said guiding means positioning the frame member such that the tape is applied only to a desired portion of the frame member;

a stop against which a first roll of tape being used is urged, the first roll of tape being aligned with said guiding means; and means for holding the first roll in place with respect to said stop;

the first roll having a central cre about which tape is wound, the central core having a thickness measured in a direction extending radially outwardly from said spindle said stop being spaced from said spindle a distance greater than the thickness of the core to allow the core of the roll of tape to be advanced past the stop after all of the tape has been removed therefrom during an application.

7. Apparatus as recited in claim 6 wherein said stop comprises a wall extending in a direction generally orthogonal of said spindle.

8. Apparatus as recited in claim 6 further comprising a recess disposed on a side of said stop opposite of said guiding means for accepting a plurality of cores from rolls of tape from which the tape has been removed.

9. Apparatus as recited in claim 6 wherein said stop comprises a wall to which said guiding means is secured.

10. Apparatus for applying tape to a member forming a component of a frame for glazing, the frame member having a shelf on which the glazing rests when the frame is formed, the tape being wound on a core and having a first side and a second side, the first side having an exposed adhesive layer and the second side having an adhesive layer covered by a release liner, said apparatus comprising;

a base;

a spindle supported at one end and spaced from said base, said spindle being adapted to accept a plurality of rolls of tape, said spindle passing through the core of each of said rolls of tape to permit the rolls of tape to rotate about an axis of said spindle during application of the tape;

a wall mounted on said base and extending generally perpendicularly of said spindle, said wall having a first side and a second side, an upper edge of said wall being spaced from said spindle a distance greater than a thickness of the core of said rolls of tape measured in a direction extending radially outwardly from the axis of said spindle;

means for holding a roll of tape to be used against the first side of said wall;

means for guiding a frame member past said spindle in alignment with said wall;

means for urging the first side of said tape into contact with the shelf on the frame member to form an adhesive bond between the tape and the shelf; and means for removably securing said guiding means to said base to allow replacement of said guiding means;

said spindle extending past said first side of the wall to allow cores of rolls of tape on said spindle from which the tape has been removed to be pushed past the first side of said wall and past said upper edge of said wall to allow another roll of tape to be advanced into position against the first side of said wall.

* * * * *